US009615162B2

(12) United States Patent
Huang et al.

(10) Patent No.: US 9,615,162 B2
(45) Date of Patent: Apr. 4, 2017

(54) EARPHONE WITH INVERSE SOUND WAVES

(71) Applicant: Jetvox Acoustic Corp., Taoyuan (TW)

(72) Inventors: Ying-Shih Huang, Taoyuan (TW); To-Teng Huang, Taoyuan (TW)

(73) Assignee: Jetvox Acoustic Corp., Taoyuan (TW)

( * ) Notice: Subject to any disclaimer, the term of this patent is extended or adjusted under 35 U.S.C. 154(b) by 124 days.

(21) Appl. No.: 14/796,606

(22) Filed: Jul. 10, 2015

(65) Prior Publication Data

US 2016/0316292 A1 Oct. 27, 2016

(30) Foreign Application Priority Data

Apr. 24, 2015 (TW) ..... 104206348 U

(51) Int. Cl.
*H04R 25/00* (2006.01)
*H04R 1/10* (2006.01)

(52) U.S. Cl.
CPC ..... *H04R 1/1091* (2013.01)

(58) Field of Classification Search
CPC ..... H04R 25/00
See application file for complete search history.

(56) References Cited

U.S. PATENT DOCUMENTS 4,965,836 A * 10/1990 Andre ..... H04R 1/1008 181/129
8,755,558 B2 * 6/2014 Saiki ..... H04R 9/063 181/171
9,055,366 B2 * 6/2015 Azmi ..... H04R 1/1075
2011/0058704 A1 * 3/2011 Harlow ..... H04R 1/1016 381/380
2012/0039500 A1 * 2/2012 Silvestri ..... H04R 1/1016 381/380
2013/0315431 A1 * 11/2013 Grinker ..... H04R 1/1016 381/380
2014/0140565 A1 * 5/2014 Liu ..... H04R 1/1091 381/380
2014/0153767 A1 * 6/2014 Hua ..... H04R 1/2803 381/380
2014/0205131 A1 * 7/2014 Azmi ..... H04R 1/1075 381/380

(Continued)

*Primary Examiner* — Olisa Anwah
(74) *Attorney, Agent, or Firm* — Muncy, Geissler, Olds & Lowe, P.C.

(57) ABSTRACT

The earphone with inverse sound waves includes an earphone housing, a high frequency driver, and a low frequency driver. The earphone housing includes an inner space, a sound output portion, and a reflecting portion. The reflecting portion receives a passive diaphragm. The high frequency driver produces high frequency sound waves and has a sound output direction toward the sound output opening. The low frequency driver is mounted in the inner space of the earphone housing by a mounting brace. The low frequency driver is located between the high frequency driver and the passive diaphragm. A sound transmitting portion is formed between the mounting brace and the earphone housing. The low frequency driver produces low frequency sound waves and has a sound output direction toward the passive diaphragm. The passive diaphragm reflects the low frequency sound waves to the sound output opening via the sound transmitting portion.

9 Claims, 6 Drawing Sheets

(56) References Cited

U.S. PATENT DOCUMENTS

| | | | | |
|---|---|---|---|---|
| 2014/0286521 | A1* | 9/2014 | Yang | H04R 1/1041<br>381/380 |
| 2014/0363040 | A1* | 12/2014 | Silvestri | H04R 1/1016<br>381/380 |
| 2016/0044405 | A1* | 2/2016 | Huang | H04R 1/1075<br>381/74 |
| 2016/0316289 | A1* | 10/2016 | Huang | H04R 1/1075 |

* cited by examiner

EARPHONE WITH INVERSE SOUND WAVES

CROSS-REFERENCES TO RELATED APPLICATIONS

This non-provisional application claims priority under 35 U.S.C. §119(a) on Patent Application No. 104206348 filed in Taiwan, R.O.C. on 2015 Apr. 24, the entire contents of which are hereby incorporated by reference.

BACKGROUND

Technical Field

The instant disclosure relates to an earphone, and more particularly, to an earphone having a low frequency driver and a high frequency driver disposed therein. A sound output direction of the low frequency driver is opposite to that of the high frequency driver. Sound waves produced by the low frequency driver are inversed to a sound output opening by a passive diaphragm.

Related Art

Because of the limitation of space, a conventional earphone is usually driven by single speaker driver to produce sound. The conventional design is beneficial to have the overall size of the earphone be thin, compact, and light to meet the requirements of in-ear headphones and ear-hugging headphones. However, a speaker driver usually has well performance on frequency response in a certain frequency range, but not that well in other frequency ranges. Generally, the certain frequency range that performed well by the speaker driver usually pertains to middle and low frequencies, and the frequency range that underperformed usually pertains to high frequency.

Therefore, a kind of earphones has been provided to improve performance of frequency response and resolution of sound. The earphone includes plural speaker drivers respectively suited with different frequency ranges. However, the distances between the speaker drivers and a sound output opening of the earphone are almost the same since the space in the earphone is limited. The response of human auditory sense varies with different frequencies of sound. For example, in the circumstance that the distances between the drivers and the eardrum of a user are the same, the user experiences strong and detailed effect regarding low frequency sound but less resolution regarding high frequency sound. In order to improve the experience of human auditory sense, two ways has been provided. One way is to change driving fashion of the earphone (e.g., lowering the volume of low frequency sound waves), and the other way is to increase the number of washers in the earphone to change the positions of the drivers. Either way drifts off the intention that the plural speaker drivers are adopted for, and requires more accommodating space. Therefore, a new kind of earphone capable of improving frequency response without changing the whole structure is needed.

SUMMARY

To address the above issue, the instant disclosure provides an earphone with inverse sound waves. An embodiment of the earphone with inverse sound waves comprises an earphone housing, a high frequency driver, and a low frequency driver. The earphone housing comprises an inner space, a sound output portion, and a reflecting portion. The sound output portion and the reflecting portion are respectively disposed at two ends of the inner space. The sound output portion comprises a sound output opening at an end thereof.

The reflecting portion receives a passive diaphragm. The high frequency driver is disposed in the earphone housing. The high frequency driver produces high frequency sound waves. The high frequency driver has a sound output direction toward the sound output opening. The low frequency driver is mounted in the inner space of the earphone housing by a mounting brace. The low frequency driver is located between the high frequency driver and the passive diaphragm. At least a sound transmitting portion is formed between the mounting brace and the earphone housing. The low frequency driver produces low frequency sound waves. The low frequency driver has a sound output direction toward the passive diaphragm. The passive diaphragm is capable of reflecting the low frequency sound waves to the sound output opening via the at least a sound transmitting portion.

According to an embodiment of the instant disclosure, the mounting brace comprises a peripheral wall. The peripheral wall comprises at least two bumps radially outwardly formed thereon. The sound transmitting portion is formed between the bumps. The mounting brace is fixed to an inner wall of the earphone housing by the bumps. Moreover, the bumps are equiangularly arranged on the peripheral wall.

According to an embodiment of the instant disclosure, the sound output portion further comprises a sound passage. The high frequency driver is disposed in the sound passage. In another embodiment, the high frequency driver is disposed in the inner space but not in the sound passage.

According to an embodiment of the instant disclosure, the earphone housing further comprises a separating net. The separating net is between and separates the passive diaphragm and the outside to prevent dusts from entering and affecting the movement of the passive diaphragm.

According to an embodiment of the instant disclosure, the earphone housing further comprises a front housing and a rear housing. The sound output portion is at the front housing, and the reflecting portion is at the rear housing. The front housing is further connected with an earplug rubber tube. The earplug rubber tube surrounds and is coupled to an outer portion of the front housing.

According to an embodiment of the instant disclosure, the passive diaphragm is disposed on the earphone housing by a connecting ring.

According to an embodiment of the instant disclosure, the mounting brace further comprises an assembly portion for assembly with a circuit assembly. The circuit assembly is electrically connected to the high frequency driver or the low frequency driver. Moreover, the circuit assembly comprises an adjusting circuit so that the phases of the high and low frequency sound waves can be adjusted into the same.

The inverse structure of the earphone of the instant disclosure utilizes the passive diaphragm to have the low frequency sound waves inversed so that the route that the low frequency sound waves pass through becomes longer. On the premise of retaining the size of the whole structure of the earphone, the sound produced by the earphone has more details.

The features of the instant disclosure will no doubt become understandable to those of ordinary skill in the art after reading the following detailed description of the preferred embodiment that is illustrated in the various figures and drawings.

DETAILED DESCRIPTION

Figure 1:
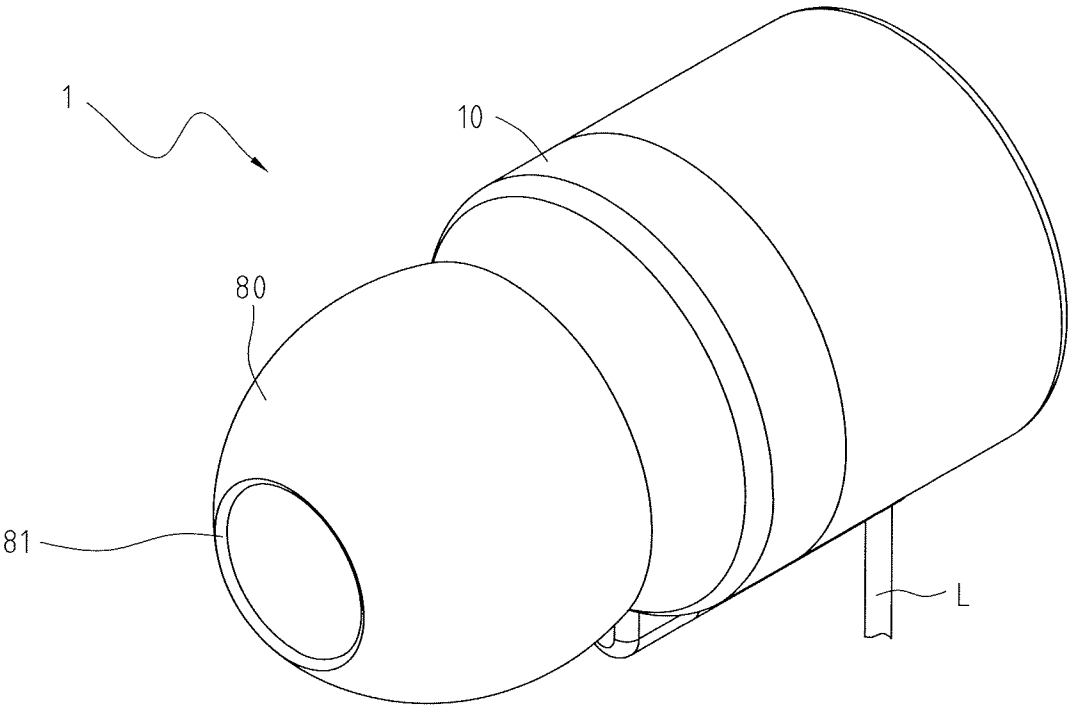
FIG. 1 illustrates a perspective view of an earphone with inverse sound waves according to an embodiment of the instant disclosure.
Figure 2:
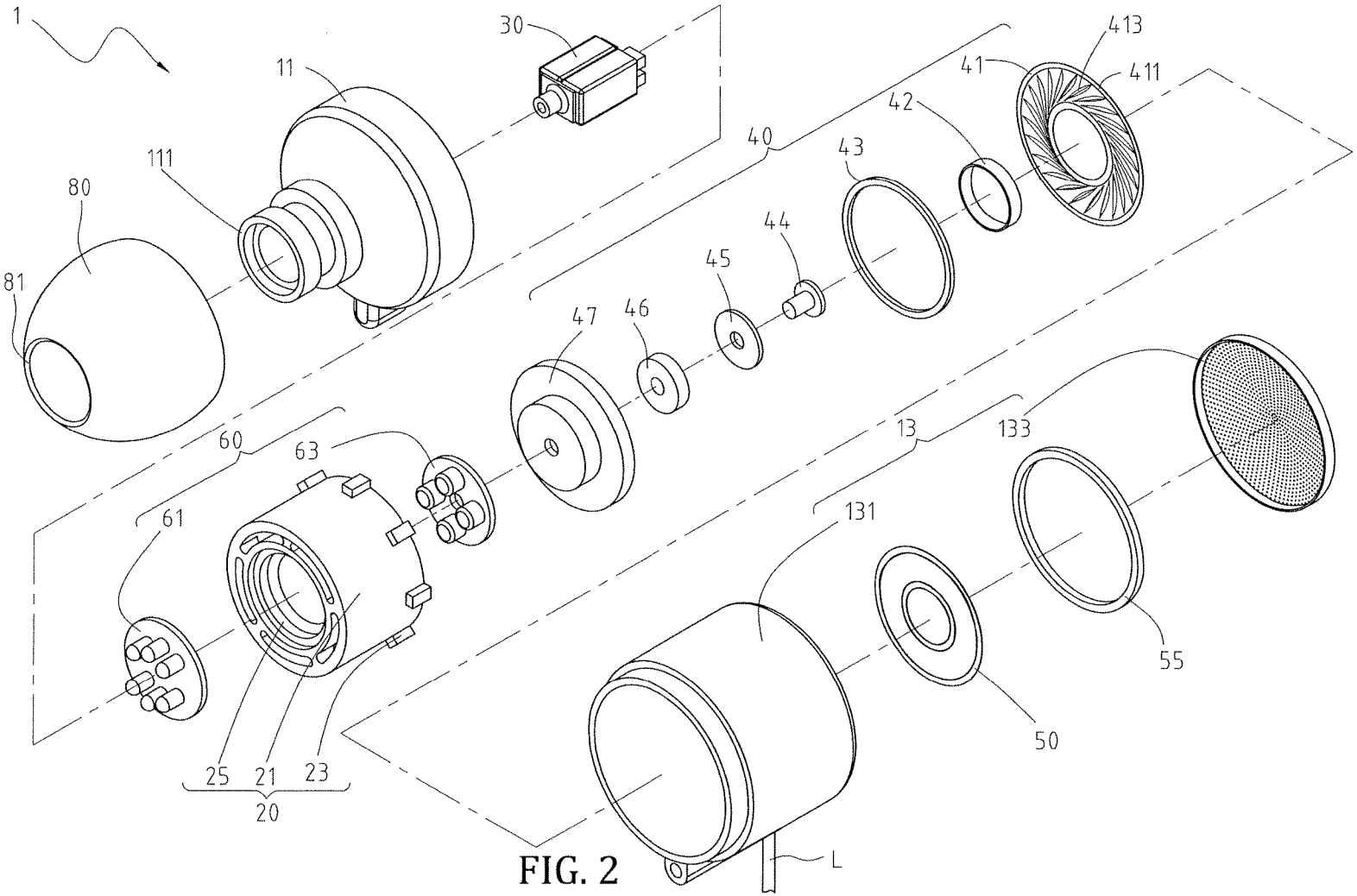
FIG. 2 illustrates an exploded view of the earphone with inverse sound waves according to a first embodiment of the instant disclosure.
Figure 3:
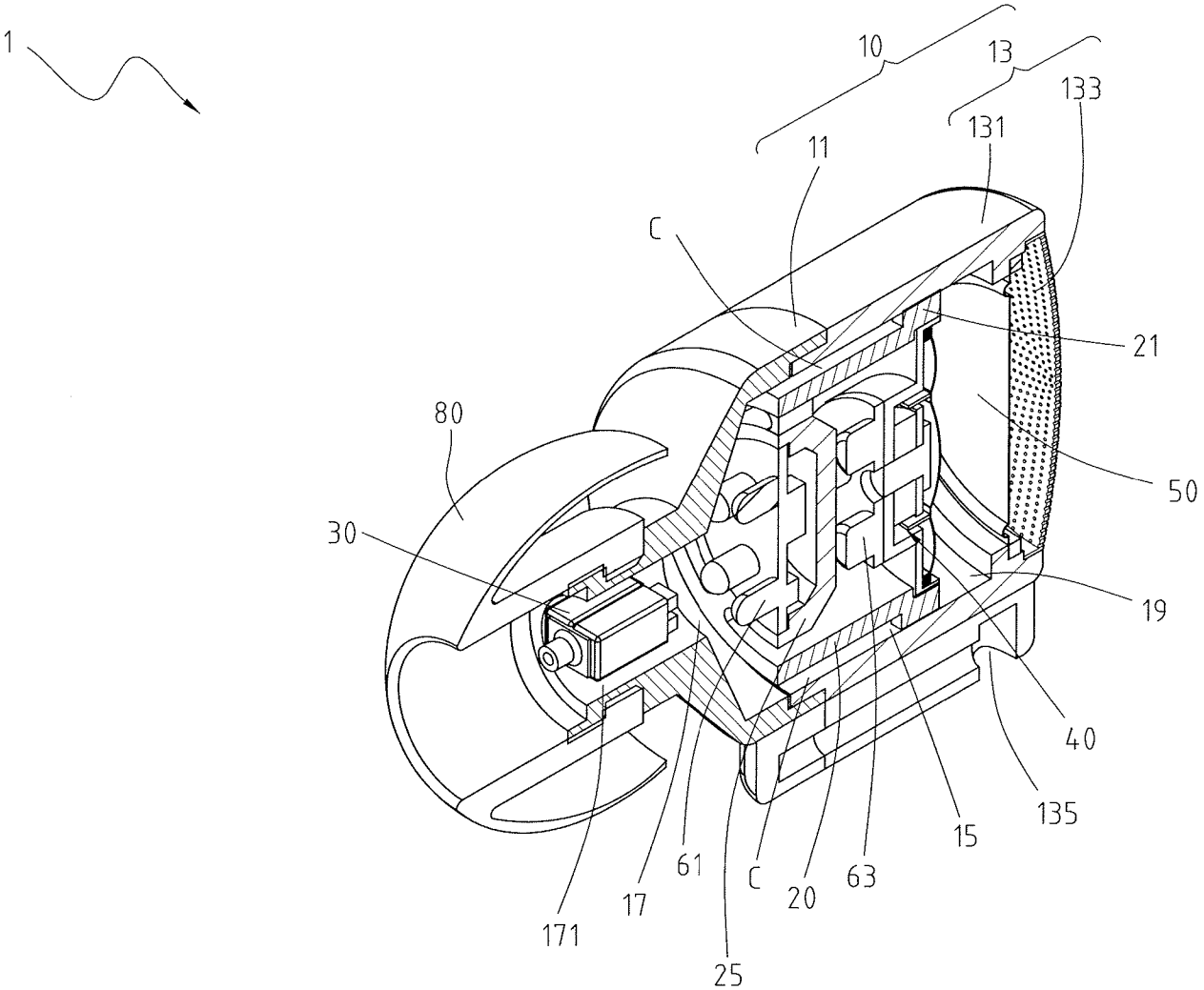
FIG. 3 illustrates a cross-sectional view of the earphone with inverse sound waves according to the first embodiment of the instant disclosure.
Figure 4:
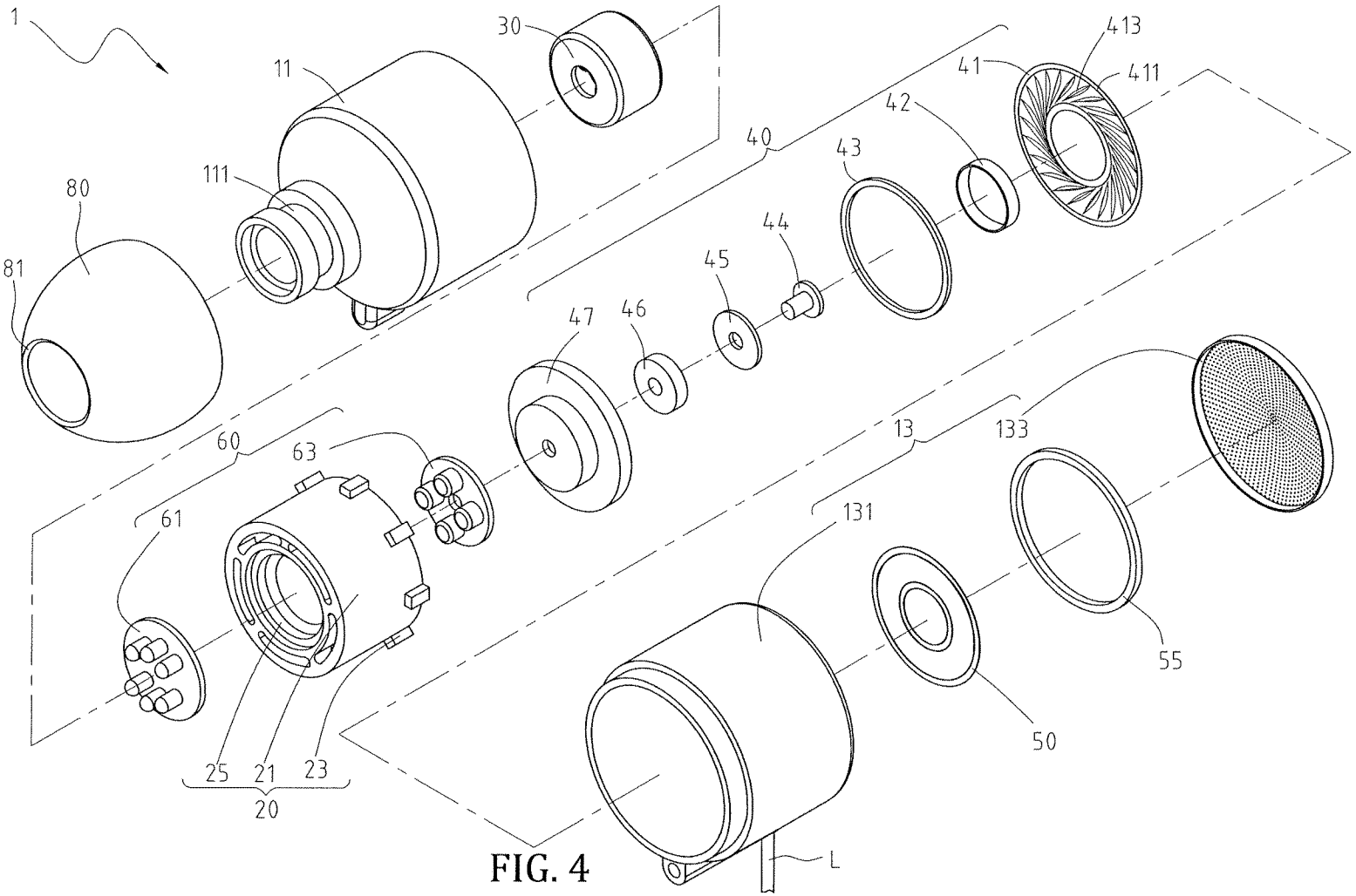
FIG. 4 illustrates an exploded view of the earphone with inverse sound waves according to a second embodiment of the instant disclosure.
Figure 5:
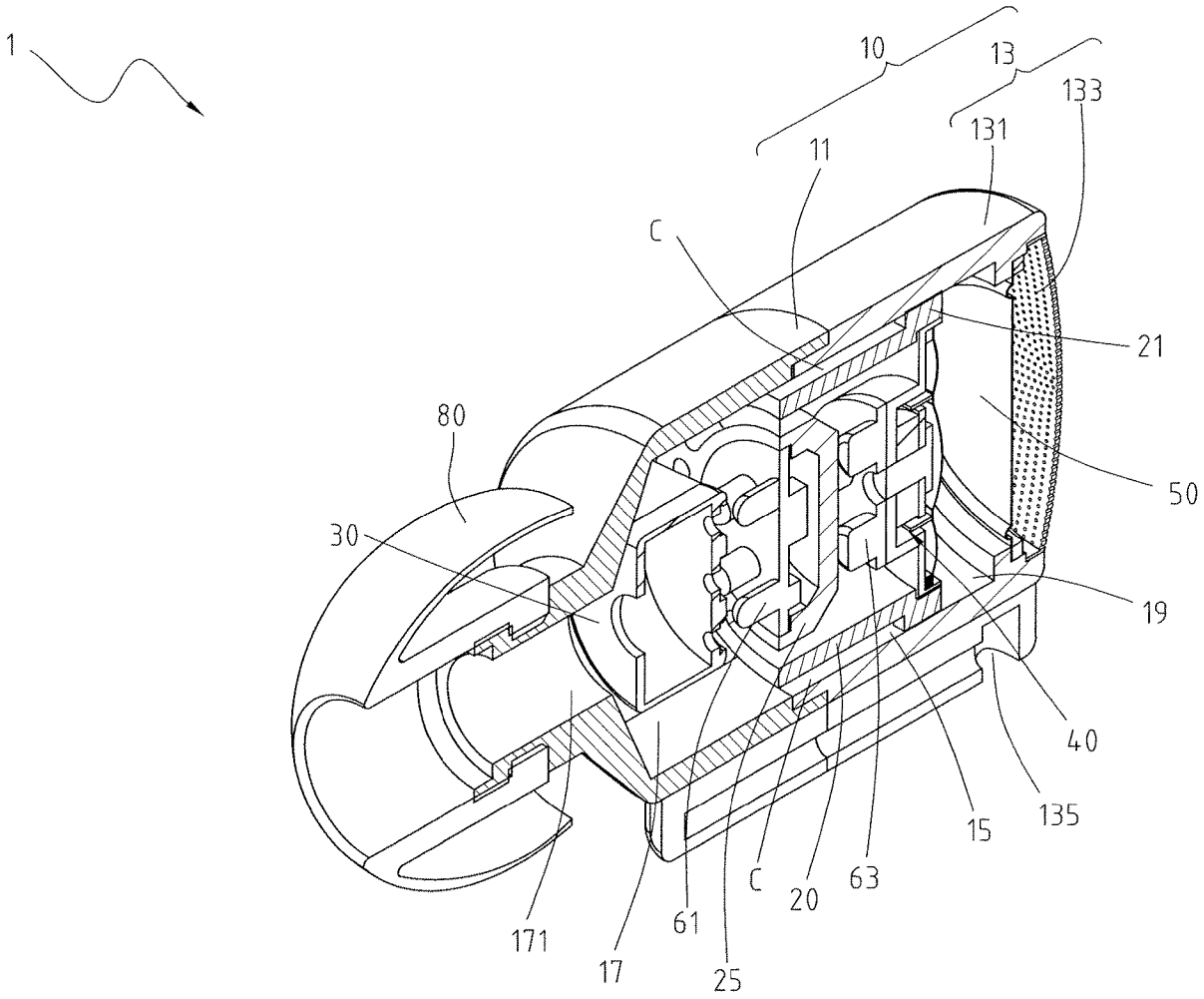
FIG. 5 illustrates a cross-sectional view of the earphone with inverse sound waves according to the second embodiment of the instant disclosure.

Referring to FIGS. 1-5, FIG. 1 is a perspective view of an earphone with inverse sound waves according to an embodiment of the instant disclosure, FIG. 2 and FIG. 3 are respectively an exploded view and a cross-sectional view of the earphone with inverse sound waves according to a first embodiment of the instant disclosure, and FIG. 4 and FIG. 5 are respectively an exploded view and a cross-sectional view of the earphone with inverse sound waves according to a second embodiment of the instant disclosure. As shown in FIGS. 1-5, the earphone 1 with inverse sound waves of the embodiments of the instant disclosure comprises an earphone housing 10, a mounting brace 20, a high frequency driver 30, a low frequency driver 40, and a passive diaphragm 50.

As shown in FIGS. 2-4, the earphone housing 10 comprises a front housing 11 and a rear housing 13. The front housing 11 comprises a sound output opening 111. The front housing 11 and the rear housing 13 are assembled to each other to form an inner space 15. Two opposite ends of the inner space 15 respectively define a sound output portion 17 and a reflecting portion 19. The sound output portion 17 is between the mounting brace 20 and the sound output opening 111. The sound output portion 17 comprises a sound passage 171. The sound passage 171 communicates with the inner space 15. The passive diaphragm 50 is disposed at the reflecting portion 19. Moreover, the passive diaphragm 50 is connected to the earphone housing 10 by a connecting ring 55.

The earphone housing 10 further comprises a separating net 133. The separating net 133 is between and separates the passive diaphragm 50 and the outside to prevent dusts from entering and affecting the movement of the passive diaphragm 50. In addition, the separating net 133 has permeability for air flowing. In the embodiments of FIGS. 2-5, the rear housing 13 comprises a body 131 and the separating net 133. The separating net 133 is connected to the body 131. The separating net 133 covers an end of the body 131. The reflecting portion 19 is formed between the separating net 133 and the low frequency driver 40. The aforementioned structure is merely an example. The rear housing 13 can also be integrated as one piece.

The high frequency driver 30 is disposed in the earphone housing 10. Moreover, the high frequency driver 30 is fastened to an inner wall of the front housing 11. The high frequency driver 30 produces high frequency sound waves. The high frequency driver 30 has a sound output direction toward the sound output opening 111. As shown in FIG. 2 and FIG. 3, the high frequency driver 30 of the first embodiment can be a driver with flat shape, and is disposed in the sound passage 171. In the embodiment, the high frequency driver 30 can be a moving iron driver, a balanced armature driver, or an armature driver. As shown in FIG. 4 and FIG. 5, the high frequency driver 30 of the second embodiment can be a driver with circular shape, and is disposed in the inner space 15 but not in the sound passage 171. The high frequency driver 30 is outside and near the sound passage 171. In the second embodiment, the high frequency driver 30 can be a moving coil driver, a moving iron driver, a piezoelectric driver, etc.

The mounting brace 20 is disposed in the inner space 15, and is coupled to an inner wall of the earphone housing 10. In the embodiments of FIGS. 2-5, the mounting brace 20 comprises a peripheral wall 21, at least two bumps 23, and an assembly portion 25. The bumps 23 are radially outwardly formed on the peripheral wall 21, and the bumps 23 are equiangularly arranged on the peripheral wall 21. The mounting brace 20 is fixed to the inner wall of the earphone housing 10 by the bumps 23. At least a sound transmitting portion C is formed between the bumps 23, and the sound transmitting portion C is formed between the mounting brace 20 and the earphone housing 10. The assembly portion 25 is for assembly with a circuit assembly 60. The circuit assembly 60 is electrically connected to the high frequency driver 30 and/or the low frequency driver 40. In some embodiments, the circuit assembly 60 can be a single printed circuit board or plural printed circuit boards. As shown in FIGS. 2-5, the circuit assembly 60 comprises a first circuit board 61 and a second circuit board 63. The first circuit board 61 is connected to the high frequency driver 30, and the second circuit board 63 is connected to the low frequency driver 40. The shape of the mounting brace 20 and the connection of the circuit assembly 60 are not limitations but merely examples.

The low frequency driver 40 is mounted and fixed in the inner space 15 of the earphone housing 10 by the mounting brace 20. The low frequency driver 40 is located between the high frequency driver 30 and the passive diaphragm 50. The low frequency driver 40 is a moving coil driver or a moving iron driver. As shown in FIG. 2 and FIG. 4, the low frequency driver 40 is, for example, a moving coil driver. The low frequency driver 40 comprises a diaphragm 41, a voice coil 42, a copper ring 43, a rivet 44, a washer 45, a magnet 46, and an iron plate 47. A first surface 411 of the diaphragm 41 is toward the passive diaphragm 50. The voice coil 42 is connected to a second surface 413 of the diaphragm 41. The second surface 413 is opposite to the first surface 411. The magnet 46 and the washer 45 are fixed to the iron plate 47 by the rivet 44. The low frequency driver 40 is fixed to the mounting brace 20 by the iron plate 47. The aforementioned structure is not a limitation but merely an example.

Figure 6:
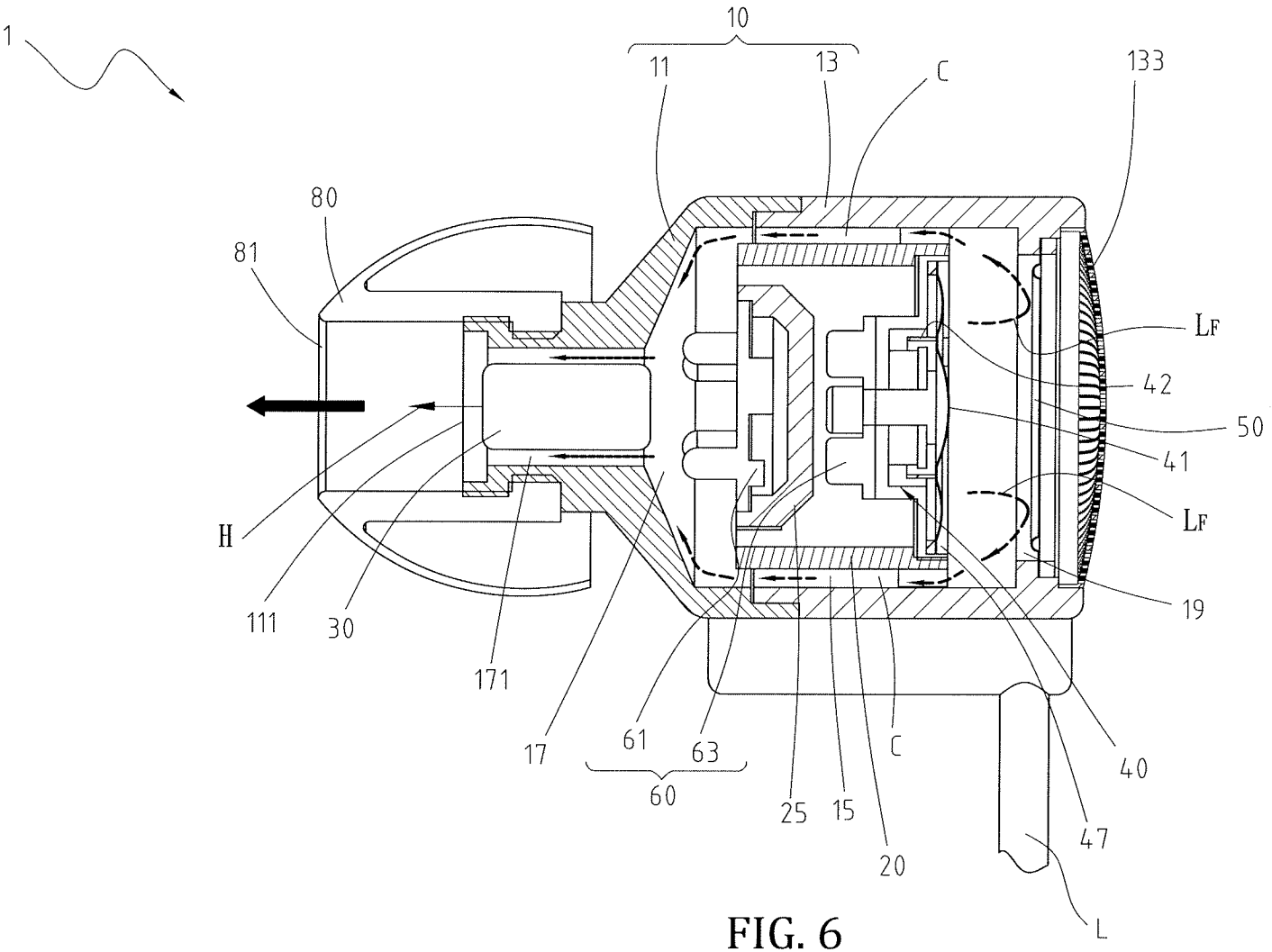
FIG. 6 illustrates a cross-sectional view of the earphone and routes of sound waves therein according to an embodiment of the instant disclosure.

Referring to FIG. 6, FIG. 6 is a cross-sectional view of the earphone and routes of sound waves therein according to an embodiment of the instant disclosure. As shown in FIG. 6, the high frequency driver 30 produces high frequency sound waves H. The high frequency sound waves H pass through the sound passage 171 to the sound output opening 111. The diaphragm 41 of the low frequency driver 40 produces low frequency sound waves $L_F$ toward the passive diaphragm 50. The low frequency sound waves $L_F$ are inversed by the passive diaphragm 50, and then reach the sound output opening 111 via the sound transmitting portion C.

Moreover, the circuit assembly 60, for example the first and second circuit boards 61, 63, further comprises an adjusting circuit. The phases of the high and low frequency sound waves H, $L_F$ can be adjusted into the same by the adjusting circuit. An audio signal line L is connected to the circuit assembly 60. The audio signal line L passes through a guiding entrance 135 of the body 131, and is connected to the first circuit board 61 or the second circuit board 63. The audio signal line L is fixed to the earphone housing 10.

In addition, the earphone 1 further comprises an earplug rubber tube 80. The earplug rubber tube 80 surrounds and is coupled to an outer portion of the front housing 11 (e.g., the earplug rubber tube 80 is fastened to an outer wall of the sound output opening 111). When the earphone 1 is worn by a user, the earplug rubber tube 80 improves the wearing experience to make the user feel comfortable. The earplug rubber tube 80 comprises an opening 81 corresponding to the sound output opening 111.

The inverse structure of the earphone of the instant disclosure utilizes the passive diaphragm to have the low frequency sound waves inversed so that the route that the low frequency sound waves pass through becomes longer. On the premise of retaining the size of the whole structure of the earphone, the sound produced by the earphone has more details and the frequency response of the sound is optimized.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. An earphone with inverse sound waves, comprising:

an earphone housing comprising an inner space, a sound output portion, and a reflecting portion, the sound output portion and the reflecting portion being respectively disposed at two ends of the inner space, the sound output portion comprising a sound output opening at an end of the sound output portion, the reflecting portion receiving a passive diaphragm;

a high frequency driver disposed in the earphone housing, the high frequency driver producing high frequency sound waves, the high frequency driver having a sound output direction toward the sound output opening; and a low frequency driver mounted in the inner space of the earphone housing by a mounting brace, the low frequency driver being located between the high frequency driver and the passive diaphragm, at least a sound transmitting portion being formed between the mounting brace and the earphone housing, the low frequency driver producing low frequency sound waves, the low frequency driver having a sound output direction toward the passive diaphragm, the passive diaphragm being capable of reflecting the low frequency sound waves to the sound output opening via the at least a sound transmitting portion.

2. The earphone with inverse sound waves of claim 1, wherein the mounting brace comprises a peripheral wall, the peripheral wall comprises at least two bumps radially outwardly formed thereon, the at least a sound transmitting portion is formed between the at least two bumps, and the mounting brace is fixed to an inner wall of the earphone housing by the at least two bumps.

3. The earphone with inverse sound waves of claim 2, wherein the at least two bumps are equiangularly arranged on the peripheral wall.

4. The earphone with inverse sound waves of claim 1, wherein the mounting brace comprises an assembly portion for assembly with a circuit assembly, and the circuit assembly is electrically connected to the high frequency driver or the low frequency driver.

5. The earphone with inverse sound waves of claim 1, wherein the sound output portion further comprises a sound passage, and the high frequency driver is disposed in the sound passage.

6. The earphone with inverse sound waves of claim 1, wherein the sound output portion further comprises a sound passage, and the high frequency driver is disposed in the inner space and outside the sound passage.

7. The earphone with inverse sound waves of claim 1, wherein the earphone housing further comprises a separating net, and the separating net is between and separates the passive diaphragm and the outside.

8. The earphone with inverse sound waves of claim 1, wherein the earphone housing further comprises a front housing and a rear housing, the sound output portion is at the front housing, the reflecting portion is at the rear housing, the front housing is further connected with an earplug rubber tube, and the earplug rubber tube surrounds and is coupled to an outer portion of the front housing.

9. The earphone with inverse sound waves of claim 1, wherein the passive diaphragm is fixed to the earphone housing by a connecting ring.

* * * * *